US008573631B2

(12) United States Patent
Rancon

(10) Patent No.: US 8,573,631 B2
(45) Date of Patent: Nov. 5, 2013

(54) DEVICE FOR RECEIVING A FOOT OR A BOOT ON A GLIDING APPARATUS

(75) Inventor: Henri Rancon, Annecy (FR)

(73) Assignee: Salomon S.A.S., Metz-Tessy (FR)

( * ) Notice: Subject to any disclaimer, the term of this patent is extended or adjusted under 35 U.S.C. 154(b) by 121 days.

(21) Appl. No.: 13/083,809

(22) Filed: Apr. 11, 2011

(65) Prior Publication Data

US 2011/0248475 A1 Oct. 13, 2011

(30) Foreign Application Priority Data

Apr. 12, 2010 (FR) ..... 10 01526

(51) Int. Cl.
*A63C 9/00* (2012.01)

(52) U.S. Cl.
USPC ..... 280/633; 280/611; 280/619; 280/14.22

(58) Field of Classification Search
USPC ..... 280/619, 633, 611, 14.22
See application file for complete search history.

(56) References Cited

U.S. PATENT DOCUMENTS

| | | | | |
|---|---|---|---|---|
| 5,499,461 | A * | 3/1996 | Danezin et al. | 36/117.2 |
| 5,727,797 | A * | 3/1998 | Bowles | 280/14.21 |
| 5,771,609 | A * | 6/1998 | Messmer | 36/89 |
| 5,894,684 | A * | 4/1999 | Sand et al. | 36/117.1 |
| 5,918,897 | A * | 7/1999 | Hansen et al. | 280/611 |
| 5,966,843 | A * | 10/1999 | Sand et al. | 36/117.1 |
| 6,138,384 | A * | 10/2000 | Messmer | 36/89 |
| 6,276,708 | B1 * | 8/2001 | Hogstedt | 280/613 |
| 6,283,492 | B1 | 9/2001 | Hale | |
| 6,485,035 | B1 | 11/2002 | Laughlin et al. | |
| 7,232,147 | B2 | 6/2007 | Couderc | |
| 7,316,412 | B2 | 1/2008 | Couderc | |
| 7,503,579 | B2 | 3/2009 | Couderc | |
| 2002/0005627 | A1 | 1/2002 | Plassiard | |
| 2002/0163161 | A1 | 11/2002 | Mandon | |
| 2005/0046150 | A1 * | 3/2005 | Couderc | 280/623 |
| 2005/0280248 | A1 | 12/2005 | Jean | |
| 2007/0132206 | A1 * | 6/2007 | Messmer et al. | 280/611 |
| 2007/0158929 | A1 * | 7/2007 | Neiley et al. | 280/617 |
| 2007/0170697 | A1 | 7/2007 | Couderc | |
| 2009/0014984 | A1 | 1/2009 | Pascal | |
| 2009/0146397 | A1 | 6/2009 | Steere | |

FOREIGN PATENT DOCUMENTS

| | | | |
|---|---|---|---|
| EP | 0 966 995 | A2 | 12/1999 |
| EP | 1 149 611 | A1 | 10/2001 |
| EP | 1 254 685 | A1 | 11/2002 |
| EP | 2 014 340 | A1 | 1/2009 |
| FR | 2 811 583 | A1 | 1/2002 |

* cited by examiner

*Primary Examiner* — John R Olszewski
*Assistant Examiner* — Steve Clemmons
(74) *Attorney, Agent, or Firm* — Greenblum & Bernstein, P.L.C.

(57) ABSTRACT

A device for receiving a foot or a boot on a gliding apparatus, the receiving device including a base plate that extends along a longitudinal direction, from a rear end to a front end, as well as a rear support element, the rear support element being articulated with respect to the base plate, in the area of the rear end, in order to be capable of being folded, selectively, towards the base plate or deployed rearwardly. The receiving device includes an abutment that limits the deployment of the rear support element with respect to the base plate. The abutment is fixed to the base plate, the abutment has a self-supporting structure, and the abutment limits the deployment of the rear support element by acting along the longitudinal direction (L). The abutment is transversely flexible in order to assume the shape of the rear support element when the latter is deployed rearward.

30 Claims, 6 Drawing Sheets

DEVICE FOR RECEIVING A FOOT OR A BOOT ON A GLIDING APPARATUS

CROSS-REFERENCE TO RELATED APPLICATION

The instant application is based upon the French priority Patent Application No. 10.01526, filed Apr. 12, 2010, the disclosure of which is hereby incorporated by reference thereto, and the priority of which is hereby claimed under 35 U.S.C. §119.

BACKGROUND OF THE INVENTION

1. Field of the Invention

The invention relates to a device for receiving a foot or a boot on a sports apparatus, in particular such as a gliding board.

2. Background Information

Devices of the aforementioned type are used for the practice of snowboarding, skiing on snow, snowshoeing, and the like.

Certain devices according to the prior art include a base plate adapted to receive the foot or the boot, as well as a rear support element, or highback, adapted to support the lower leg of a user. The rear support element is connected to the base plate, generally by means of an articulation, such as a pivot connection, so as to be capable of being folded towards the base plate, i.e., in a closing direction. This reduces the space requirement and facilitates storage of the device. An abutment is also provided which limits the deployment of the rear support element with respect to the base plate, i.e., movement of the rear support element in an opening direction.

This configuration is frequent in snowboarding, wherein both feet of the rider are retained on the same board by means of a pair of retention devices, or bindings, and oriented in a substantially transverse direction with respect to the board, i.e., the feet extending at an angle with respect to a vertical longitudinal median plane of the board. For each such binding, transverse forces are therefore localized toward the ends of the toes or towards the heel. In the case of forces directed toward the ends of the toes, little or no force is opposed by the rear support element. Conversely, during forces directed toward the heel of the rider, the force for which the rear support element must oppose can be substantially high. Consequently, the aforementioned abutment of each binding also opposes such forces. For example, during rearward edging while riding, i.e., when edging toward the heels, the rear support element of each binding transfers rear impulse forces that are transmitted by the lower leg. In other cases, the rear support element returns impulse forces coming from the ground to the rider. These impulse forces, i.e., in both directions, are transferred via the abutment.

The prior art has proposed various structures in order to provide a receiving device, or binding, with ad hoc mechanical properties and characteristics.

In particular, a base plate is known to include a lateral flange and a medial flange connected to one another by a base and an arch, i.e., a heel loop. The base supports the sole of the boot, and the arch extends around the heel, i.e., around the back of the boot. The rear support element is articulated with respect to the base plate in the areas of the intersection of the opposite ends of the arch with respective ones of the flanges, while being arranged forward of the arch. An abutment is fixed to the rear support element so as to be supported by the arch, when the lower leg sends rear impulse forces. This well-tested structure enables a satisfactory control of the board. However, it has some disadvantages.

First, the heel is not optimally supported. This means that the heel is not always held with adequate comfort or precision, at least during certain steering or board-control phases, such as during certain riding modes.

If the rear support element is relatively rigid, for a "sport" riding mode, for example, the contact between the boot and the rear support element is not uniform. In other words, the boot does not completely assume the shape of the rear support element, thereby resulting in an uneven distribution of the pressures related to the contact with one another, certain portions of the boot being overly compressed, while a clearance remains in the areas of other portions.

If the rear support element is more flexible, for a more comfortable steering or riding mode, the contact between the boot and the rear support element is negatively affected by the action of the arch. The arch is rigid, particularly transversely rigid, because it cooperates with the abutment. In fact, the arch returns point loads to the boot, via the abutment and the rear support element, and sometimes only via the rear support element, in the area in which the rear support element comes in direct support on the arch.

Consequently, heel support sometimes lacks comfort and precision, especially in the case of extreme or prolonged use, which negatively affect steering and control of the board.

Another disadvantage is the complexity of the structure. The base plate, with its base and its arch, is a three-dimensional element whose shapes make it difficult to manufacture. Furthermore, the structure according to this first family calls for a rather large number of elements. This is particularly the case for the abutment, whose position is adjustable, and for which it is necessary to provide an adjustment mechanism. In general, at least one screw, a washer, and a nut, in addition to the abutment itself, are necessary to provide the adjustment mechanism. Added to this are a long assembly time, high manufacturing costs, and a considerable weight. This is due partially to the arch, as it must be sufficiently solid to withstand the vertical thrusts exerted by the abutment.

Thus, the known devices, although enabling a satisfactory control of the board with which they are associated, can be further improved.

SUMMARY

To this end, the invention, which is described hereinafter, generally provides an improvement for a device for receiving a foot on a sports apparatus, such as a snowboard binding.

In particular, the invention provides an improved heel support, i.e., to increase comfort and/or precision in holding the heel. The invention also provides a simplified structure for such a device. Further, the invention provides for a reduction in the number of elements necessary for manufacturing such a device. Furthermore, the invention shortens the time required to assemble the device, and to reduce its costs. The invention further decreases the weight of a foot-receiving device or binding. Finally, the invention provides for such a device or binding to be easy to handle, in particular with respect to folding or deploying the rear support element, or highback, in relation to the base plate.

To this end, the invention is directed to a device for receiving a foot or a boot on a gliding apparatus, the receiving device including a base plate that extends along a longitudinal direction, from a rear end to a front end, as well as a rear support element articulated with respect to the base plate, in the area of the rear end, in order to be capable of being folded towards the base plate or deployed, the receiving device including an abutment that limits the deployment of the rear support element in relation to the base plate.

The abutment, fixed to the base, has a self-supporting structure. The deployment of the rear support element is limited by the action of the abutment along the longitudinal direction.

The abutment of the receiving device according to the invention is transversely flexible in order to assume the shape of the rear support element, or highback, when the latter is deployed rearward.

This arrangement enables the boot and the rear support element to better fit one another. In other words, the contact between the boot and the rear support element is more even, or even uniform. Consequently, the contact pressures are evenly distributed between these two components. As a result, advantageously, heel support is more comfortable and/or more precise.

Furthermore, the proposed arrangement simplifies the structure of the receiving device. As a result, advantageously, the number of elements necessary for its manufacturing is reduced, the assembly time is shorter, and the manufacturing costs are lower than for the known devices. It is also noted that the weight of the device according to the invention is reduced, in particular because it does not include an arch, i.e., a heel loop extending behind the boot between the medial and lateral flanges.

It is further noted that the folding zone of the rear support element remains clear, due to the self-supporting characteristic of the abutment. As a result, advantageously, handling the device for storage, by folding the rear support element towards the base, is easier.

Thus, it can be said that the invention is an improvement to a receiving device, or a device that comprises an improvement.

BRIEF DESCRIPTION OF THE DRAWING

Other characteristics and advantages of the invention will be better understood from the description that follows, with reference to the annexed drawing illustrating, by way of non-limiting embodiments, how the invention can be embodied, and in which.

DETAILED DESCRIPTION

Although the embodiments described hereinafter relate more specifically to the field of snowboarding, it is to be understood that they also apply to other fields as mentioned hereinabove.

The first embodiment is described with reference to FIGS. 1 to 7.

Figure 1:
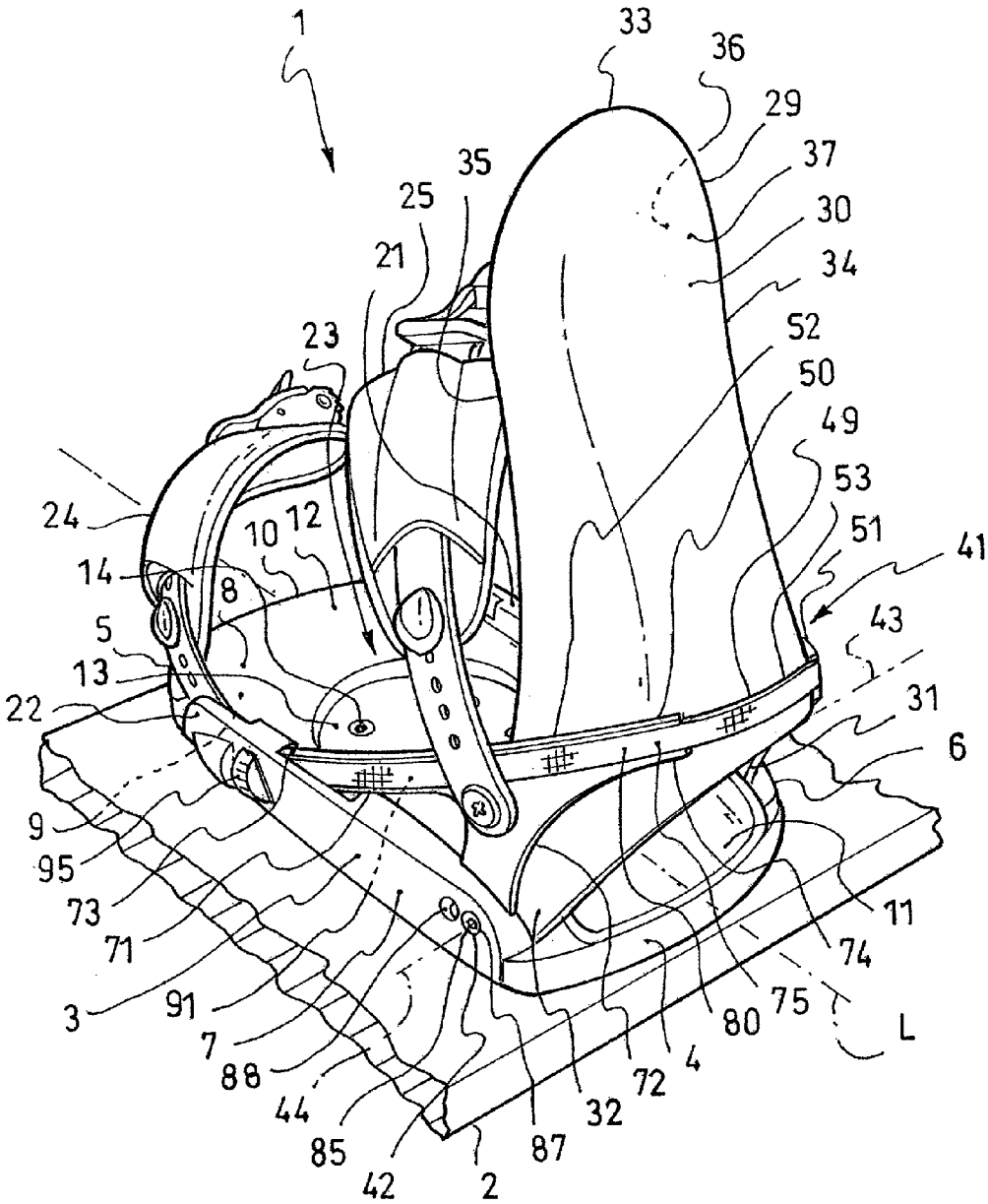
FIG. 1 is a rear perspective view of a receiving device, according to a first embodiment of the invention, in the case in which the rear support element is in the deployed position.

As shown in perspective in FIG. 1, a receiving device 1 enables a boot, not shown, to be temporarily received on a board 2.

In a known fashion, the receiving device 1, or snowboard binding in the illustrated embodiment, includes a base plate 3 that extends lengthwise in a longitudinal direction L, between a rear end 4 and a front end 5, and widthwise, from a first side 6 to a second side 7.

The base plate 3 has an upper surface 8 adapted to be opposite the sole of the boot, and a lower surface 9 adapted to be above the board 2.

The base plate 3 preferably includes a base 10, associated with a rear cushion or pad 11 and a front cushion or pad 12. The base 10 is a rigid element which at least partially demarcates the lower surface 9 of the base plate. The cushions at least partially demarcate the upper surface 8. According to the first illustrated embodiment, the cushions 11, 12 are arranged at the rear and the front, respectively, of the base plate 3. This enables a damped contact with the heel or the tip of the front end of the sole of the boot.

Other structures, in respective alternative embodiments, can be provided for the base plate 3, such as, for example, a base associated with a single cushion, which extends from the rear end 4 to the front end 5 of the base plate 3. The latter is retained to the board 2 by a means made in the form of a disc 13, which is itself retained to the board 2 by a plurality of screws 14.

Other structural arrangements for retaining the base plate relative to the board, within the scope of the invention, can be provided.

The base plate 3 is laterally bordered with a first portion shown in the form of a first flange 21, and by a second portion shown in the form of a second flange 22. In this case, the first flange 21 is lateral and the second flange 22 is medial, but the opposite is also within the scope of the invention. The flanges 21, 22 are connected to one another through the means of the base 10. Thus, the base 10 and the flanges 21, 22, extending upwardly from the base 10, demarcate a zone 23 for receiving the boot of the user, i.e., the boot of the rider. When the boot is positioned on the device 1, the flanges 21, 22 extend laterally along the sole. According to the invention, a structure other than the flanges 21, 22 can be provided to form the lateral and medial portions. For example, abutments can be used, such as abutments formed unitarily with the base or otherwise.

In a particular embodiment, the base plate 10 and the flanges 21, 22 form a unitary element made of a synthetic material, for example. However, the flanges 21, 22 can be provided as elements that are affixed to the base by any means, such as adhesive bonding, welding, screws, nesting, i.e., by means of a friction-fit or snap-fit, or by means of other structures.

Two straps or other linkages are also provided to removably retain the boot on the base plate 3, between the flanges 21, 22, in the receiving zone 23.

A first strap 24 is located towards the front, in the area of the boot corresponding to the metatarsophalangeal articulation of the foot, when the foot is retained. A second strap 25 is located towards the rear, in the area of the boot corresponding to the instep of the foot, when the foot is retained.

Each of the straps 24, 25 extends transversely between the flanges 21, 22.

Alternatively, a different number of straps can be provided.

The device 1 further includes a rear support element 29, or highback, which enables the rider to be supported at the rear of the lower leg. The rear support element 29 includes a body 30 that extends longitudinally or lengthwise from between first 31 and second 32 fastening ends to a free end 33, transversely between a first side 34, or lateral side, and a second side 35, or medial side, and depthwise or thicknesswise between a support surface 36, and a free surface 37, the free surface facing rearwardly in the deployed position of the rear support element.

The support surface 36 is structured and arranged to receive the back of the lower leg of the rider, the rear support element 29 and the base plate 3 being therefore associated, as will be described more in detail hereinafter.

Figure 2:
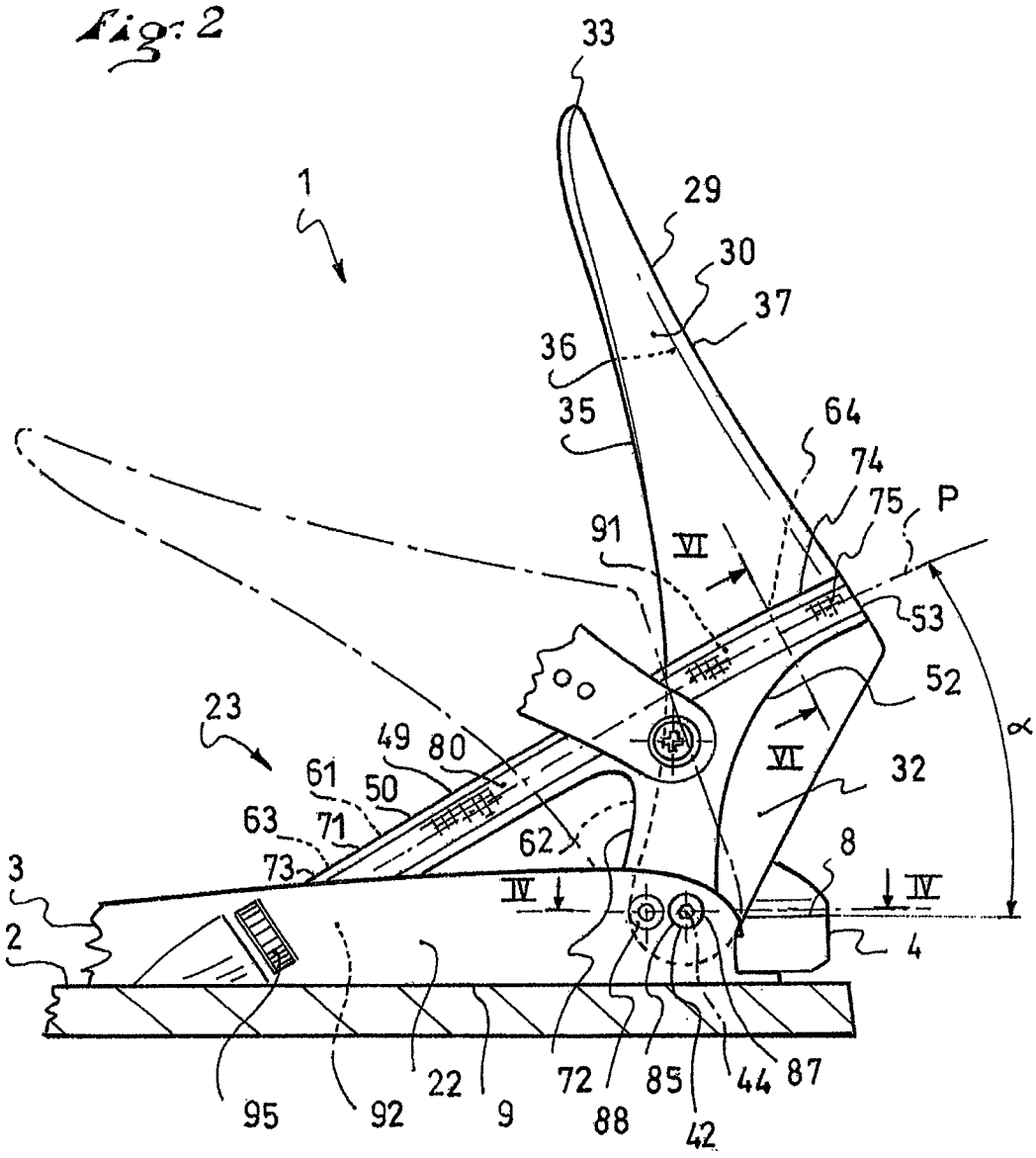
FIG. 2 is a partial side view of the device of FIG. 1, showing how the rear support element can be folded towards the base plate.
Figure 3:
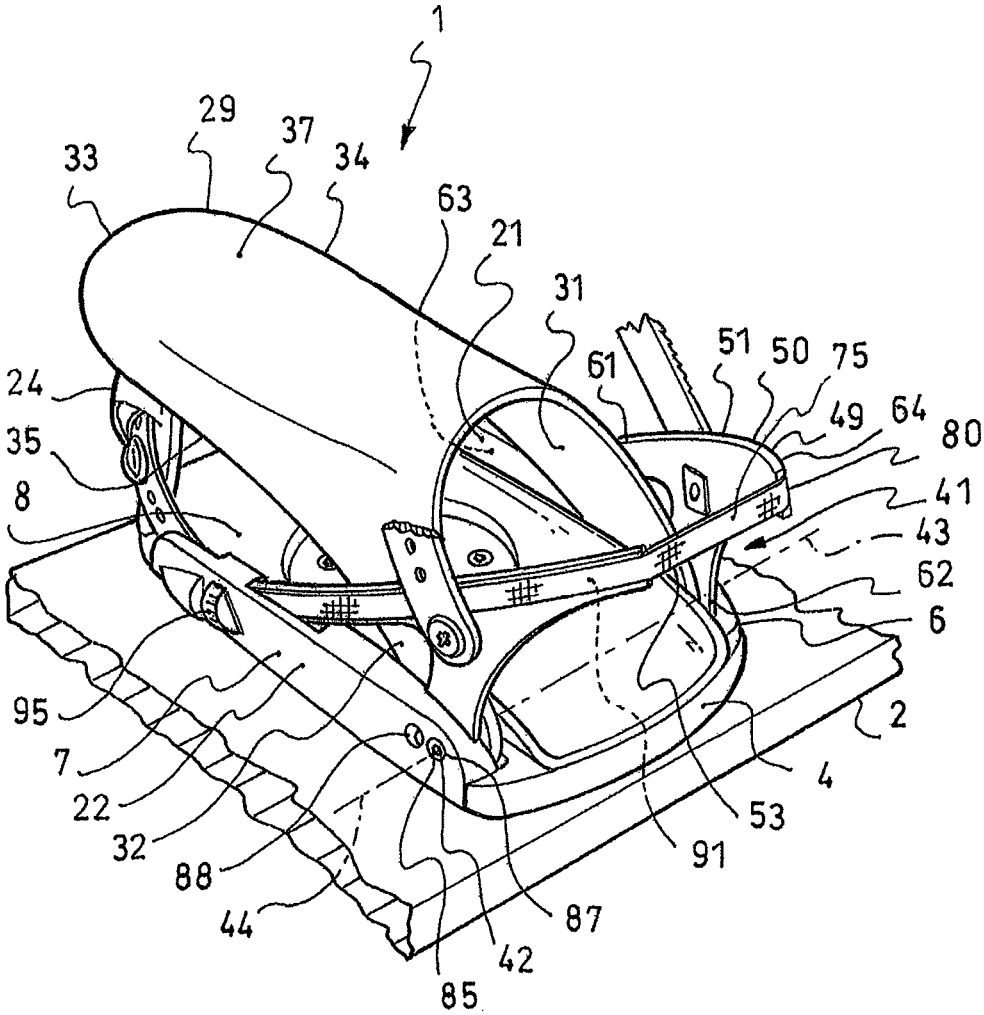
FIG. 3 is a view similar to FIG. 1, in the case in which the rear support element is in the folded position.

As can be understood with reference to FIGS. 1 to 3, the rear support element 29 is articulated with respect to the base plate 3, in the area of the rear end 4, in order to be capable of being selectively folded towards the base plate or moved oppositely in to a deployed position. To this end, the rear support element is connected to the flanges 21, 22 via of a first articulation 41, located in the area of the first fastening end 31, and via a second articulation 42, located in the area of the second fastening end 32. Thus, the first fastening end 31 is connected to the first flange 21 and the second fastening end 32 is connected to the second flange 22. Each articulation 41, 42 is substantially oriented along a first transverse axis 43 and a second transverse axis 44, respectively, of the device 1. Each articulation 41, 42 thus allows for a rotational movement of the rear support element 29 with respect to the base plate 3. As an advantage resulting from this, storage is facilitated.

The receiving device 1 further includes an abutment 49 that limits the deployment of the rear support element 29 with respect to the base plate 3.

According to the invention, the abutment 49 is fixed to the base plate 3, or at least fixed relative to the base plate, has a self-supporting structure, and limits the deployment of the rear support element 29 by acting along the longitudinal direction L of the base plate 3. This arrangement enables a more even, or even uniform contact between the boot and the rear support element. Therefore, the arrangement provides the receiving device 1 with a simple structure. As a result, advantageously, the number of elements necessary for the manufacturing is reduced, the assembly time is short, and the manufacturing costs are relatively low.

Furthermore, the self-supporting characteristic of the abutment 49 ensures that the latter remains outside of the folding zone of the rear support element 29, in the sense that the abutment 49 is not opposite to the base plate 10. A resulting advantage is that storage is made easier, after folding the rear support element 29 towards the base plate 3.

In a non-limiting configuration, according to the first embodiment, the abutment 49 is comprised of an arch 50. The arch 50 includes a lateral support 51, affixed to the first side 6, a medial support 52, affixed to the second side 7, as well as a bridge 53 that connects the lateral and medial supports 51, 52 to one another. The arch 50 extends around the rear support element 29, or highback, on the side of the free surface 37 thereof, i.e., on the rear side of the rear support element.

More precisely, and by way of example, the lateral support 51 includes a tie rod 61 and a foot 62. The tie rod 61 extends lengthwise from a front end 63, affixed to the first flange 21, to a rear end 64, which connects the tie rod to the bridge 53. The foot 62 connects the first flange 21 to the tie rod 61; in the illustrated embodiment, the foot 62 connects a rear end of the flange 21 to the tie rod 61 in the area of the rear end 64 of the tie rod. Thus, the tie rod 61 is inclined with respect to the flange 21 or the base plate 3, so that its rear end 64 is positioned farther away, i.e., higher, from the rear end 4 of the base plate 3. The tie rod 61, and consequently the support 51, is oriented along the longitudinal direction L of the base plate 3.

Similarly, the medial support 52 includes a tie rod 71 and a foot 72. The tie rod 71 extends lengthwise from a front end 73, affixed to the second flange 22, to a rear end 74, which connects to the bridge 53. The foot 72 connects the second flange 22 to the tie rod 71, in the area of the rear end 74 of the latter. Thus, the tie rod 71 is inclined with respect to the flange 22 or the base plate 3, so that its rear end 74 is farther away from the rear end 4 of the base plate 3. The tie rod 71, and consequently the support 52, is oriented along the longitudinal direction L of the base plate 3.

As seen previously, the bridge 53 connects the lateral support 51 and the medial support 52 to one another. According to the first illustrated embodiment, the bridge 53 connects the rear ends 64, 74 of the tie rods 61, 71 of the supports 51, 52 to one another, the lateral and medial supports 51, 52 being transversely spaced apart between the rear ends 64, 74. Consequently, the bridge 53 is raised above the base plate 3, in the area of its rear end 4. As can be better understood hereinafter, it is this arrangement that enables the arch 50, and thus the abutment 49, to limit the deployment of the rear support element 29 by acting along the longitudinal direction L.

Consequently, the arch 50 includes a band 75 formed by the tie rods 61, 71 and the bridge 53. In other words, the band 75 connects a first anchoring end 63, or point, of the arch 50 on the base plate 3 to a second anchoring end 73, or point, of the arch 50 on the base plate 3. The width of the band 75 lies in a substantially vertical plane, whereas its longitudinal axis extends in a plane P inclined at an angle $\alpha$ with respect to the upper surface 8 of the base plate 3. The angle $\alpha$ ranges between 20° and 50° and, in a particular embodiment, the angle $\alpha$ is 30° or approximately 30°. The band 75 extends around the rear support element 29 on the side of the free surface 37. The band 75 forms the abutment 49. It is transversely flexible in order to assume the shape of the rear support element 29, when the latter is deployed rearward. The deployment of the rear support element 29 is thus limited by the action of the band 75 forming the abutment 49 in the longitudinal direction L. In the deployment position, the abutment 49 engages a rear of the rear support element 29 from a lateral edge to a medial edge thereof.

This construction enables the abutment 49, in comparison to conventional arches of the prior art, to be optimally dimensioned and to be lightened, i.e., having less weight and a smaller size, the latter with regard to transverse cross section, for example. Indeed, to limit the rotation of the rear support element 29, the band 75 is biased in the plane P or along a direction that is substantially close to the plane P. Consequently, the band 75 works in tension. The force exerted by the rear support element 29 is then distributed longitudinally between the two arms of the band 75, namely the two tie rods 61, 71, and is taken up in the area of the anchoring ends, or points, 63 and 73. The band 75 being biased mainly in tension, it can be designed so that the tensile strength is preferred along its longitudinal direction corresponding to a force extending substantially within the plane P. Similarly, this construction makes it possible to provide the band 75 with flexibility when it is biased transversely, i.e., by means of a force substantially perpendicular to the width of the band 75, inasmuch as the abutment 49 is not significantly biased transversely when it blocks the rotation of the rear support element 29. In addition, with this design, the abutment 49 is not significantly biased vertically or along a direction substantially perpendicular to the plane P. Consequently, it is not necessary to dimension the abutment 49 so as to make it very rigid and strong when it is biased along a direction that is non-coplanar with the plane P.

In other words, the band 75 functions like bracing stays.

It is noted that in the prior art, the self-supported arches that contribute to limiting the rotation of the rear support element include a structure that is reinforced and relatively rigid in order to resist forces along a substantially vertical direction. This dimensioning adds mass and weight to the binding and thus penalizes the comfort of the rider. The majority of bindings of the state of the art include a part attached to the rear support element, which comes in contact with the top of the arch. The force transmitted between the rear support element and the arch occurs in the area of this contact and is therefore substantially vertical. The arch must therefore be sufficiently solid to take up the forces, hence the vertical rigidity. Similarly, the arch must resist a transverse bias to ensure that the part is properly held. The arch is likely to collapse when constrained, if it is not rigid transversely. The arches of the prior art are thus not biased in the same manner as the arch of the present invention. They generally work in compression rather than in tension.

Taking into account the fact that the band 75 is mainly biased in tension, it is advantageous for it to be dimensioned to improve its longitudinal tensile strength. To this end, the band 75 can include or be made of a wire, a strap, a material including longitudinally oriented fibers. The band 75 can also include a plurality of discrete elements. For example, the band can comprise a first element in the form of a channel made of plastic material, such as PU or polyester, in which passes a second element in the form of a strap and/or a wire made of a material such as PA or EP UHMW. There can be a material discontinuity along the band 75 if the latter ensures, along its entire length, a good longitudinal tensile strength.

Important to the construction being described here is the presence of the enveloping band 75, which surrounds the rear support element 29 and is anchored on the base plate 3, and, in particular embodiment(s), at the front of the base plate 3, in order to work as much as possible in tension. To make sure that the abutment 49 is self-supported, the arch 50 incorporates feet 62, 72. Within the scope of the invention is an embodiment in which a partition, partial or not, is positioned in the space between the feet 62, 72 and the band 75.

According to the first embodiment, the arch 50 includes a linkage, made in the form of a strap 80, which extends along the lateral support 51, and along the medial support 52. The portion of the strap which connects the supports 51, 52 forms the bridge 53. In other words, the strap 80 forms the bridge 53. More precisely, the strap 80 extends along the tie rod 61 of the lateral support 51, as well as the tie rod 71 of the medial support 52, the strap 80 connecting the rear ends 64, 74 of the tie rods 61, 71 to one another.

The strap 80 is transversely flexible and inextensible. Consequently, the strap 80 can bend but it cannot stretch lengthwise, at least under normal conditions of use. Because of these properties the arch 50, therefore the abutment 49, completely assumes the shape of the rear support element 29, when the latter is deployed rearward as is the case in FIGS. 2 and 3. The tie rods 61, 62 and the strap 80, therefore also the bridge 53, come in contact with the free surface 37 of the rear support element 29 so that the wide surfaces thereof lie against and exert pressure on the surface 37 of the support element. Because the tie rods 61, 71 are longitudinally oriented towards the front 5 of the base plate 3, the tie rods 61, 71 are biased in tension when a boot pushes the rear support element 29 in a direction of deployment, i.e., towards the rear 4. Consistent with the foregoing, the bridge 53 is then also biased in tension. As a result, the abutment 49, via its arch 50, acts on the rear support element 29 in the manner of a bracing stay. In this way, the abutment 49 limits the deployment of the rear support element 29 by acting along the longitudinal direction L of the base plate 3, i.e. in a front-to-rear direction. The mode of action of the abutment 49 makes it possible to provide it with the simple structure described hereinabove and shown in the drawing. It is indeed much easier, from a mechanical point of view, to manage tensile stress.

According to the first embodiment as illustrated, the lateral 51 and medial 52 supports have substantially the same dimensions and are opposite one another transversely. Consequently, the tie rods 61, 71 and the feet 62, 72 are opposite one another transversely, and the bridge 53 extends parallel to the base plate 3. This balances the tensile stress exerted by the abutment 49, i.e., by the arch 50. Indeed, this stress is distributed evenly between the first side 6 and the second side 7: the tensile stress in the tie rod 61 of the lateral support 51 is equal or close to the tensile stress in the tie rod 71 of the medial support 52. This provides stability when the boot is supported against the rear support element 29.

The front end 63 of the tie rod 61, therefore the front end of the lateral support 51, is closer to the front end 5 than to the rear end 4. Similarly, the front end 73 of the tie rod 71, therefore the front end of the medial support 52, is closer to the front end 5 than to the rear end 4. Thus, the longitudinal axes of the tie rods 61 and 71 form, or lie within, the plane P. The free surface 37 of the rear support element 29, when pressing against the arch 50, is perpendicular or substantially perpendicular to the plane P, as can be understood in particular with reference to FIG. 2. This configuration optimizes work in tension, along the longitudinal direction L and towards the front 5 of the arch 50, therefore of the abutment 49.

Figure 4:
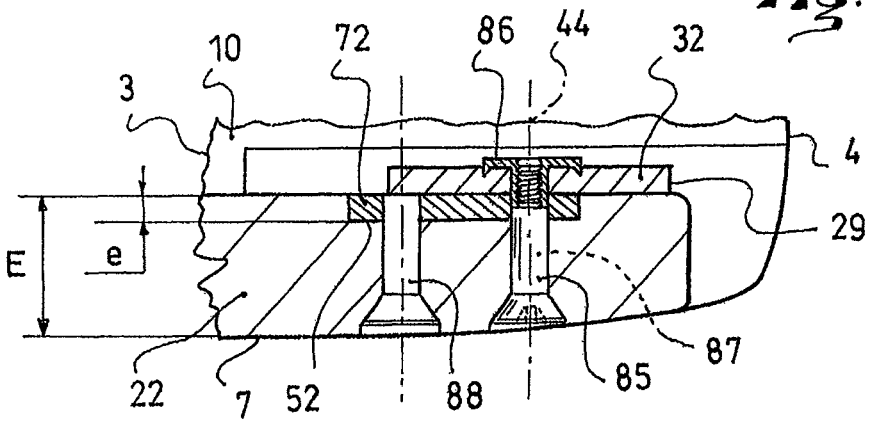
FIG. 4 is a cross section along the line IV-IV of FIG. 2.
Figure 5:
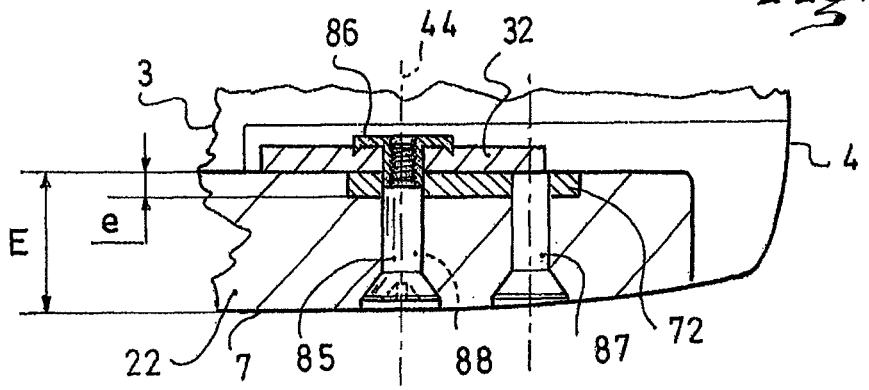
FIG. 5, similar to FIG. 4, shows an alternative adjustment of the device.

As can be understood not only with reference to FIGS. 1 to 3, but also with reference to FIGS. 4 and 5, the position of the rear support element 29 with respect to the base plate 3 can be adjusted. This means that it is possible to move each of the fastening ends 31, 32 selectively forward or backward. The position of each articulation 41, 42 can be said to be adjustable with respect to the base plate 3 or to the flanges 21, 22. By way of example, a displacement is achieved by disassembling, and then reassembling one or two articulations 41, 42 of the rear support element 29 with respect to the base plate 3.

As shown in FIGS. 4 and 5, in the case of the medial flange 22, the articulation 42, for example, includes a screw 85 and a nut 86. The medial flange 22 here has two openings 87, 88 to receive the screw 85. Alternatively, more than two openings can be provided and, as another alternative, a longitudinally extending slot can be provided rather than a plurality of openings. In any case, the axis of the screw, the axis of an opening 87, 88, in the illustrated embodiment, and the axis 44 of the second articulation merge with one another. The same is true for the articulation 41 in the area of the lateral flange 21.

Clearly, the second fastening end 32, in FIG. 4, is arranged in a setback position along the medial flange 22. The fastening end 32 is therefore closest to the rear end 4. Conversely, the fastening end 32, in FIG. 5, is arranged in a more forward position. It is thus not as close to the rear end 4. Of course, the position of the articulation 42 changes.

It is possible to select positions that are opposite one another or, alternatively, offset with respect to one another, for the articulations 41, 42. Consequently, the position of the rear support element 29 can be advanced, moved back, or rotationally adjusted along a virtual axis perpendicular to the base plate 3. This mechanism therefore makes it possible to adjust the inclination of the rear support element 29 when it comes in contact with the abutment 49, and to adjust the angular orientation of the rear support element 29 about a substantially vertical axis.

In the illustrated embodiment, only two openings 87, 88 per flange 22 illustrate the adjustment mechanism. More openings or other means incorporating notches are within the scope of the invention for allowing for a greater number of configurations for adjusting the inclination and/or the angular orientation of the rear support element 29.

In addition, the thickness e of each support 52, 53, measured for example in the area of the foot 62, is less than the thickness E of the flange 22 to which it is fixed. For example, the thickness e of a support ranges between 0.5 and 5 mm, although values from 1 to 3 mm can yield satisfactory results. A reduced thickness of the supports 51, 52, therefore of the tie rods 61, 71 and of the feet 62, 72, is sufficient to provide them with their necessary mechanical tensile strength, while enabling transverse flexibility. This improves the ability of the abutment 49 to assume the shape of the rear support element 29. The thickness E of the flange 22 ranges between 5 and 15 mm, although values from 5 to 8 mm can yield satisfactory results. A greater thickness of the flanges 21, 22 provides the base plate 3 with rigidity which, for example, enables precise transverse support of the boot sole.

The base plate 3, as well as flanges 21, 22 and supports 51, 52, are made from any suitable materials, such as plastic materials.

According to the first embodiment of the invention, each support 51, 52 is an element attached on the base plate 3, i.e., actually or effectively affixed to a flange 21, 22. Consequently, the abutment 49, or the arch 50, is an element attached on the base plate 3. The attachment is carried out, for example, by nesting, which is consolidated by the articulation 41, 42 involved. Indeed, in addition to enabling the rear support element 29 to pivot or articulate, each connection or articulation, with its screw 85 and its nut 86, maintains a support 51, 52 in contact with a respective flange 21, 22. It is therefore possible to make one support, or both supports, from a material different from that of the base plate 3, i.e., different from the constituent material of the flanges 21, 22. The constituent material of the supports 51, 52 is selected to be more flexible than the constituent material of the base plate 3. This makes it possible to provide the various elements of the device 1 with the appropriate mechanical properties corresponding to the demands made of them during use of the retaining device or binding of the invention.

Figure 6:
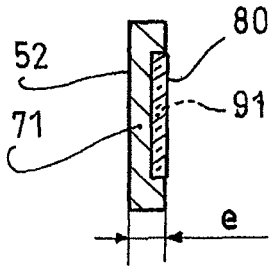
FIG. 6 is a cross section along the line VI-VI of FIG. 2.

As can be understood in particular with reference to FIG. 6, each tie rod 61, 71 has a channel or guide 91 adapted to cooperate with the strap 80. The guide 91 is made here in the form of a groove, outwardly facing in relation to the arch, in which the strap 80 is positioned. The latter is therefore naturally maintained along the tie rods 61, 71. This arrangement preserves the self-supporting ability of the abutment 49, or of the arch 50, while benefiting from the flexibility of the strap 80, in particular in its role in the area of the bridge 53.

Figure 7:
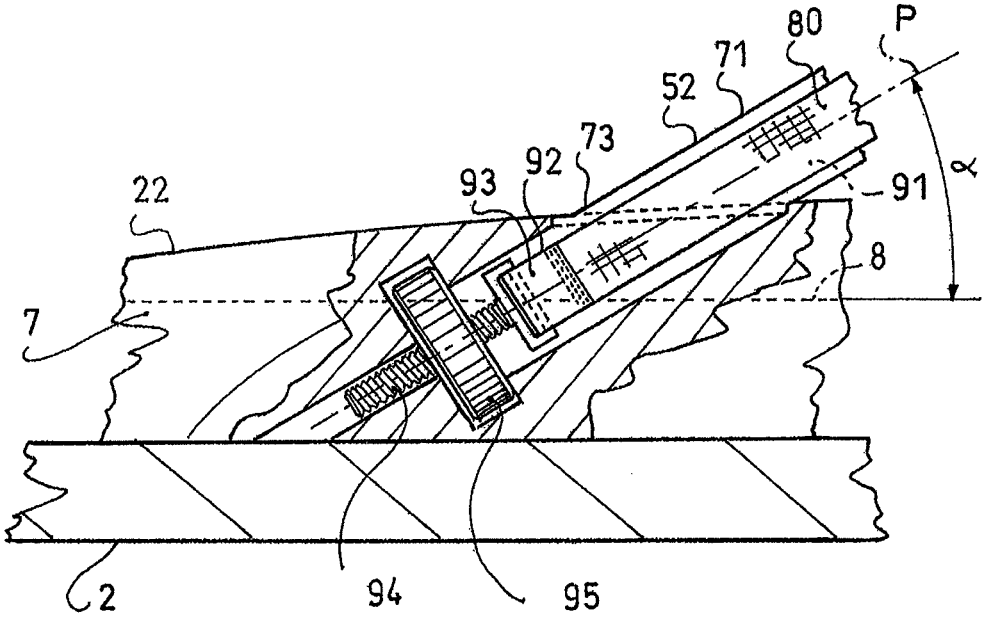
FIG. 7 is an exploded partial view of FIG. 2.

Without it being mandatory, it is possible, as shown in detail in FIG. 7, to adjust the tension of the strap 80. Consequently, because of the transverse flexibility of the supports 51, 52, the length of the arch 50 is adjustable. This makes it possible to adjust the geometry of the abutment 49 so as to correspond the most precisely possible to the shape of the boot. Boot support is thereby made only better.

In practice, the receiving device 1 includes a mechanism for adjusting the length of the strap 80. For example, in the illustrated embodiment, an end 92 of the strap 80 has a loop 93 fixed to a screw 94 by means of a fitting fixed to the end of the screw which as a part extending within the loop as shown. The end of the strap could be connected to the screw by any of other alternative arrangements. The screw 94 is housed within a flange 22. A knurled wheel 95, which can be actuated by hand, cooperates with the screw 94 to maintain or modify the working length of the strap 80. Thus, the length of the arch 50 is adjusted by turning the knurled wheel 95, thereby turning the screw.

Figure 8:
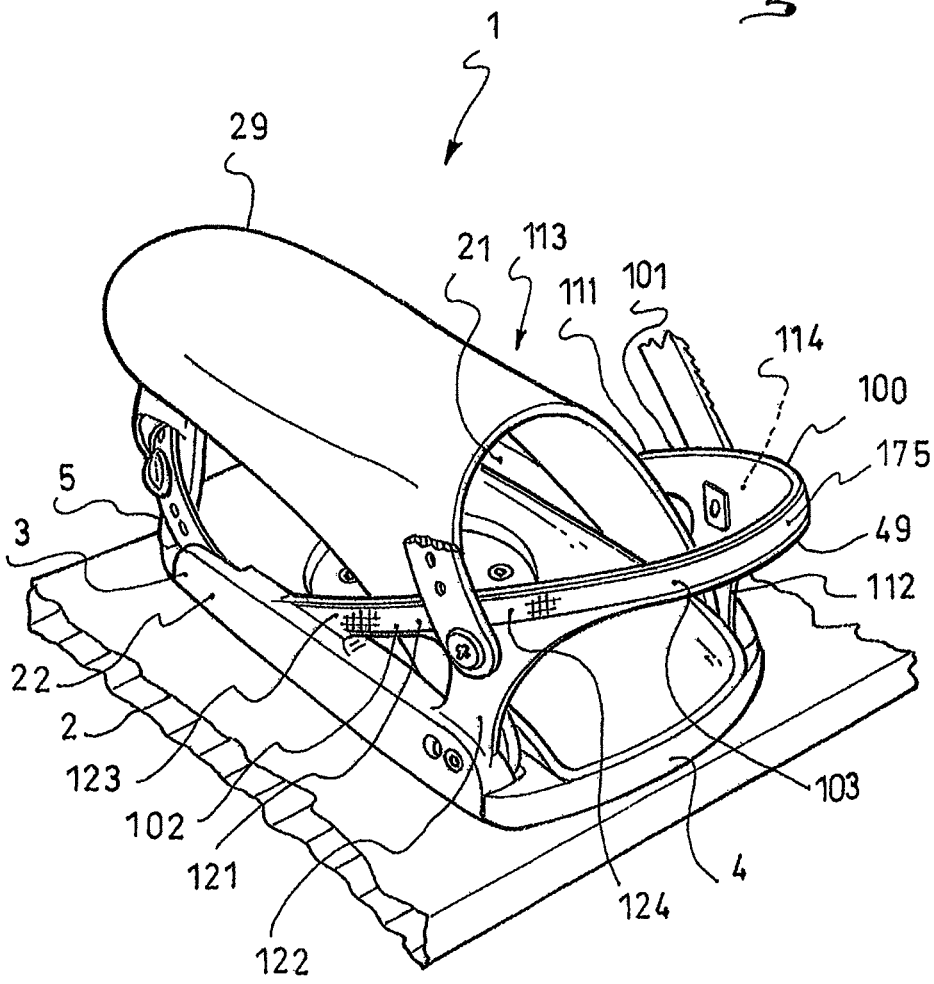
FIG. 8 is a perspective rear view of a receiving device, according to a second embodiment of the invention.

The second embodiment is described hereinafter with reference to FIG. 8. For reasons of convenience, the parts similar to those of the first embodiment are designated by the same reference numerals.

This embodiment thus generally includes a receiving device 1 having, in particular, a base plate 3, first 21 and second 22 flanges, a rear support element 29, as well as an abutment 49.

The structure of the abutment 49 of the device 1 of the second embodiment is somewhat different. Although the abutment is still an arch 100 including a lateral support 101, a medial support 102, and a bridge 103, the supports 101,102 and the bridge 103, in this embodiment, form a unitary element. In other words, the arch 100 is a unitary element. Given that, as shown and described with reference to the first embodiment, a lateral 101 or medial 102 support includes a tie rod 111, 121, a foot 112, 122, a front end 113, 123 and a rear end 114, 124, respectively, the tie rods 111, 121, the feet 112, 122 and the bridge 103 form a unitary element. This element is made of a plastic material, for example, the thickness of which ranges between 0.5 and 5 mm, although values from 1 with 3 mm yield satisfactory results.

The operation of the abutment 49 is similar to that of the first embodiment.

The arch 100 also includes an enveloping band 175 surrounding the rear support element 29 and anchored at the front 113, 123 of the base plate 3 in order to work as much as possible in tension. The band 175 includes a portion of the support 101, a portion of the support 102, and the bridge 103.

The arch 100 has a self-supporting structure. It is transversely flexible in order to assume the shape of the rear support element 29, when the latter is deployed rearward. The deployment of the rear support element 29 is therefore limited by the action of the band 175 forming the abutment 49 along the longitudinal direction L.

In a non-limiting configuration, the arch 100 or abutment 49 itself forms a unitary element with the base plate 3. Alternatively, however, the arch can be provided to be separate from the base plate 3, and attached on the latter by any means known to one of ordinary skill in the art.

Alternatively, the band 175 can include a groove adapted to receive a retaining wire or strap similar to the strap 80 of the first embodiment. This reinforcement makes it possible to improve the tensile strength of the band 175, and thus to improve the retention of the abutment 49.

Generally, the invention is embodied from materials and according to techniques of implementation known to one of ordinary skill in the art.

The invention is not limited to the particular embodiments illustrated and described, and includes all of the technical equivalents that fall within scope of the claims that follow.

For example, the abutment 49, or the arch 50,100, can include a single material or, on the contrary, a plurality of portions made of various materials. In this second case, the portions are attached to one another, either fixedly, or movably with respect to one another. In particular, the strap 80 can be immobilized or, on the contrary, can slide in its guide 91.

The abutment 49 and more particularly the band 75, 175 could, for example, include a series of segments that are articulated with respect to one another, in the manner of a chain or a watch band.

In a particular embodiment, the first and second anchoring points 63, 113; 73, 123 of the bands 75, 175 are both close to the front end of the base plate 3, in the first half of the length of the base plate 3, advantageously in the first third.

Advantageously, the width of the band 75, 175 is less than two centimeters in order to obtain a lightened structure.

The band 75, 175 can be in the form of a wire. In this case, it is part of a self-supported structure.

Further, the invention illustratively disclosed herein suitably may be practiced in the absence of any element which is not specifically disclosed herein.

The invention claimed is:

1. A device for receiving a foot or a boot on a gliding apparatus, the receiving device comprising:

a base plate extending in a longitudinal direction from a rear end to a front end;

a rear support element structured and arranged to support rearwardly the lower leg of a user of the device;

an articulation structure arranged to articulate the rear support element with respect to the base plate in an area of the rear end of the base plate to enable the rear support element to be moved selectively with respect to the base plate between a forward folded position and a rearward deployment position;

an abutment structured and arranged to limit rearward movement of the rear support element with respect to the base plate at the deployment position;

at the deployment position of the rear support element with respect to the base plate, the abutment being fixed to the base plate and having a self-supporting structure, the rearward movement of the rear support element at the deployment position being limited by action of the abutment along the longitudinal direction, the abutment being transversely flexible in order to assume a shape of the rear support element in the deployment position.

2. A receiving device according to claim 1, wherein:

the abutment is an element attached on the base plate.

3. A receiving device according to claim 1, wherein:

the abutment forms a unitary element with the base plate.

4. A receiving device according to claim 1, further comprising:

an adjustment mechanism structured and arranged to enable an adjustment of inclination of the rear support element, while the rear support element is engaged with the abutment, and/or an adjustment of angular orientation of the rear support element about a virtual axis perpendicular to the base plate.

5. A receiving device according to claim 1, wherein:

the arch includes a band connecting a first anchoring point of the arch on the base plate to a second anchoring point of the arch on the base plate;

the band has a longitudinal axis extending entirely within a single plane inclined at an angle with respect to an upper surface of the base plate.

6. A receiving device according to claim 1, wherein:

in both the forward folded position and in the rearward deployment position, the abutment has a self-supporting structure.

7. A receiving device according to claim 1, wherein:

the abutment consists of a single abutment structured and arranged to limit rearward movement of the rear support element with respect to the base plate at the deployment position.

8. A device for receiving a foot or a boot on a gliding apparatus, the receiving device comprising:

a base plate extending in a longitudinal direction from a rear end to a front end;

a rear support element structured and arranged to support rearwardly the lower leg of a user of the device;

an articulation structure arranged to articulate the rear support element with respect to the base plate in an area of the rear end of the base plate to enable the rear support element to be moved selectively with respect to the base plate between a forward folded position and a rearward deployment position;

an abutment structured and arranged to limit rearward movement of the rear support element with respect to the base plate at the deployment position;

the abutment comprising an arch extending around the rear support element on a free surface side of the rear support element;

at the deployment position of the rear support element with respect to the base plate, the abutment being fixed to the base plate and having a self-supporting structure, the rearward movement of the rear support element at the deployment position being limited by action of the abutment along the longitudinal direction, the abutment being transversely flexible in order to assume a shape of the rear support element in the deployment position.

9. A receiving device according to claim 8, wherein:

the arch includes a band connecting a first anchoring point of the arch on the base plate to a second anchoring point of the arch on the base plate, the band having a longitudinal axis extending within a plane inclined at an angle with respect to an upper surface of the base plate.

10. A receiving device according to claim 9, wherein:

the first and second anchoring points of the arch are both closer to the front end than to the rear end of the base plate.

11. A receiving device according to claim 9, wherein:

the band is flexible in bending and rigid in longitudinal tension.

12. A receiving device according to claim 9, wherein:

the band includes a plurality of discrete elements.

13. A receiving device according to claim 12, wherein:

the plurality of discrete elements of the band comprises:

a channel having a groove, the groove outwardly facing in relation to the arch; and a strap positioned within the groove.

14. A receiving device according to claim 9, wherein:

the band includes a wire or a strap.

15. A receiving device according to claim 9, further comprising:

a mechanism for adjusting a working length of the band.

16. A receiving device according to claim 8, wherein:

the arch includes a lateral support, a medial support, and a bridge connecting the lateral support and medial support to one another.

17. A receiving device according to claim 16, wherein:

the lateral support, the medial support, and the bridge form a unitary element.

18. A receiving device according to claim 16, wherein:

a strap forms the bridge.

19. A receiving device according to claim 18, wherein:

the strap is discrete from the lateral and medial supports.

20. A receiving device according to claim 19, wherein:

the bridge consists of the strap.

21. A receiving device according to claim 16, wherein:

the lateral support includes a tie rod and a foot;

the medial support includes a tie rod and a foot.

22. A receiving device according to claim 16, further comprising:

a lateral flange and a medial flange extending upwardly from lateral and medial sides, respectively, of the base plate;

a thickness of each of the medial support and lateral support being less than a thickness of respective ones of the medial flange and lateral flange to said medial support and lateral support are fixed.

23. A receiving device according to claim 16, wherein:

the lateral support and the medial support have respective rear ends, the rear ends being transversely spaced apart;

the bridge is discrete from the lateral and medial supports.

24. A device for receiving a foot or a boot on a gliding apparatus, the receiving device comprising:

a base plate extending in a longitudinal direction from a rear end to a front end;

a rear support element structured and arranged to support rearwardly the lower leg of a user of the device;

an articulation structure arranged to articulate the rear support element with respect to the base plate in an area of the rear end of the base plate to enable the rear support element to be moved selectively with respect to the base plate between a forward folded position and a rearward deployment position;

an abutment structured and arranged to limit rearward movement of the rear support element with respect to the base plate at the deployment position;

the abutment comprising a transversely flexible and longitudinally inextensible element structured and arranged to be in tension between the base plate and the rear support element when a user applies a rearwardly directed force against the rear support element in the rearward deployment position;

in both the forward folded position and in the rearward deployment position, the abutment having a self-supporting structure.

25. A receiving device according to claim 14, wherein:

in the deployment position, the abutment extends around and engaging a rear of the rear support element from a lateral edge to a medial edge of the rear support element.

26. A receiving device according to claim 24, wherein:

the receiving device does not include a transversely rigid heel loop extending rearward of the rear support element and between the lateral and medial sides of the base plate.

27. A receiving device according to claim 24, wherein:

the abutment consists of a single abutment structured and arranged to limit rearward movement of the rear support element with respect to the base plate at the deployment position.

28. A snowboard binding comprising:

a base plate extending in a longitudinal direction between a rear end to a front end and in a transverse direction between a lateral side and a medial side;

a highback structured and arranged to support rearwardly the lower leg of a user of the binding;

an articulation structure arranged to articulate the highback with respect to the base plate in an area of the rear end of the base plate to enable the highback to be moved selectively with respect to the base plate between a forward folded position and a rearward deployment position;

an abutment comprising an arch, the arch comprising a band extending in a direction around a free surface side of the highback, the arch comprising:

a lateral support extending above the lateral side of the base plate;

a medial support extending above the medial side of the base plate;

a bridge extending between the lateral and medial supports;

in the rearward deployment position, the free surface of the highback being positioned between the lateral and medial supports and forward of the bridge;

the band being transversely flexible and formed at least by the bridge and at least respective portions of the lateral and medial supports;

the abutment being structured and arranged to limit rearward movement of the highback with respect to the base plate in the rearward deployment position of the highback by a tension force imposed on the band in said direction.

29. A snowboard binding according to claim 28, wherein:

the band comprises a transversely flexible and longitudinally inextensible element structured and arranged to have said tension force imposed on it in said direction.

30. A snowboard binding according to claim 29, wherein:

the transversely flexible and longitudinally inextensible element extends over respective exterior surfaces of the lateral and medial supports.

* * * * *